US006430772B1

(12) United States Patent
Stricklin

(10) Patent No.: US 6,430,772 B1
(45) Date of Patent: Aug. 13, 2002

(54) DUCT CLEANING APPARATUS

(75) Inventor: Kenneth R. Stricklin, Atlanta, GA (US)

(73) Assignee: IAQ, Inc., Atlanta, GA (US)

( * ) Notice: Subject to any disclaimer, the term of this patent is extended or adjusted under 35 U.S.C. 154(b) by 0 days.

(21) Appl. No.: 09/497,139

(22) Filed: Feb. 3, 2000

(51) Int. Cl.[7] ..... A47L 9/00

(52) U.S. Cl. ..... 15/323; 15/304; 15/315; 15/340.1; 15/345

(58) Field of Search ..... 15/323, 340.1, 15/345, 315, 304

(56) References Cited

U.S. PATENT DOCUMENTS 3,585,788 A * 6/1971 Wilson ..... 15/314
3,926,596 A * 12/1975 Coleman ..... 15/340.1
3,955,236 A * 5/1976 Mekelburg ..... 15/314
4,200,950 A * 5/1980 Coverley ..... 15/314
4,366,594 A * 1/1983 Hyams ..... 15/314
4,446,591 A * 5/1984 Wiedemann ..... 15/302

* cited by examiner

*Primary Examiner*—Chris K. Moore
(74) *Attorney, Agent, or Firm*—Kilpatrick Stockton LLP

(57) ABSTRACT

A duct cleaning apparatus having one or more suction hose racks for storing straight lengths of suction tubing. Because the suction hose racks allow suction hose to be stored efficiently within the duct cleaning apparatus, the apparatus may include sufficient storage space for simultaneously storing multiple straight lengths of suction hose, a portable duct cleaning unit, a boroscope, and other tools. The duct cleaning apparatus may also have a plurality of air hoses which may be operated simultaneously to allow users to perform two or more air sweeps simultaneously on a duct.

10 Claims, 6 Drawing Sheets

DUCT CLEANING APPARATUS

TECHNICAL FIELD

This invention relates generally to duct cleaning equipment and relates, in particular, to a truck-mounted vacuum unit for cleaning the air ducts of houses and other structures.

BACKGROUND OF THE INVENTION

Houses and other buildings are commonly heated and cooled using a heating, ventilation, and air conditioning (HVAC) system. Such systems typically include a furnace for heating air. This furnace is attached at one end to a supply duct and at another end to a return duct. When the HVAC system is turned on, air moves from the interior of the house, through the supply duct, and into the furnace. The furnace then heats the air and returns the air to the interior of the house via a return duct.

Because, when activated, the HVAC system pumps dusty air from the interior of the house through the air ducts of the house, dust and other debris frequently accumulate on the interior of the air ducts. Such a buildup of debris can cause the quality of the air within the house to deteriorate because, as streams of air move through the ducts, debris from within the ducts may dislodge from the interior of the ducts and travel along with the air as the air flows through the ductwork and back into the house. This can adversely affect the health of those inhabiting the house.

To solve this problem, a technique has been developed for removing debris from within the air ducts of the HVAC system. This technique involves placing a suction source within the air ducts of the HVAC system, and then, while the suction source is activated, inserting a high-pressure air hose into the ducts upstream from the suction. The high-pressure air hose is then used to blow a stream of highly-compressed air within the ducts to dislodge debris from the interior surfaces of the ducts. The debris is then sucked into the suction source and removed from the interior of the duct.

To accomplish this technique, a duct-cleaning apparatus is generally used that has the following components: (1) a compressor; (2) an air hose for delivering compressed air from the compressor to the interior of the air ducts; (3) a suction source; (4) a suction hose for connecting the suction source to the interior of the air ducts; (5) a filtration system for filtering debris from the air that is removed from the air ducts; (6) a transportation platform for transporting the duct cleaning apparatus; and (7) a storage compartment for storing the air hose and suction hose during transportation.

To use the apparatus, a technician generally cuts a hole, sufficient to receive a suction hose, into one of the air ducts near the furnace. The technician then connects one end of the suction hose to the suction source and feeds the other end of the suction hose into the hole in the air duct. Next, the technician cuts one one-inch hole in the air duct approximately every ten feet upstream from the suction hose, and attaches a nozzle to the end of the air hose. The technician then turns the suction source on, which creates a suction within the duct, as will be discussed in more detail below. Next, the technician feeds the nozzle of the air hose through each of the one-inch holes and uses the air hose to dislodge debris from the interior of the air duct by spraying the interior of the duct with a stream of highly pressurized air. The airborne debris is then sucked into the suction source and removed from the interior of the duct. A filtration system then removes the debris from the air passing through the suction hose.

In order to use the air hose to remove debris from the interior of an air duct, a technician may perform either a forward or reverse "air sweep" within the duct. Before performing a reverse air sweep, the technician attaches a reverse air sweep nozzle to the end of the air hose. Such reverse air sweep nozzles include a series of jets that point back toward the air hose. After the suction source has been activated, the technician activates the air compressor and then feeds the air hose into one of the one-inch holes in the ductwork. The technician then gradually feeds the air hose upstream in the air duct in relation to the suction hose. As the air hose moves through the duct, the air hose blows air downstream against the sides of the duct and dislodges debris from the sides of the duct.

Before performing a forward air sweep, the technician attaches a forward air sweep nozzle to the end of the air hose. Such forward air sweep nozzles include a series of jets that point away from the air hose. After the suction source has been activated, the technician activates the air compressor and then feeds the air hose into one of the one-inch holes in the ductwork. The technician then gradually feeds the air hose downstream in the air duct in relation to the suction hose. As the air hose moves through the air duct, the air hose blows air downstream against the sides of the air ducts and dislodges debris from the sides of the duct.

Two different general types of duct cleaning apparatuses are currently known in the art. The first type of apparatus is a portable duct cleaner that comprises a small, portable gas-powered compressor and suction source that may be transported within the interior of a van to the building to be serviced. Once there, the portable duct cleaner is lifted from the van, wheeled into the building to be serviced and then used to clean the air ducts of the building. The disadvantage of these portable duct cleaners is that, because the duct cleaner must be small enough to fit into the back of a van, the size (and, therefore, power) of the portable compressor and suction source is limited. Also, because these portable duct cleaners tend to be heavy, two technicians are required to remove them from the transport van. A further disadvantage of these portable duct cleaners is that they are gas-powered, and therefore should not be operated within an enclosed space. One advantage of these portable duct cleaners is that, because they are small and capable of being moved within the interior of a building, they can be used to access hard-to-reach ducts.

A second type of prior art duct cleaning apparatus is a duct cleaning truck that comprises a large compressor and suction source mounted in a truck and powered by the power takeoff (PTO) of the truck. As shown in FIG. 7, the typical prior-art-duct cleaning truck has an array of inflatable cloth filters disposed beneath top doors that open to extend the air filters in operation. A storage compartment receives suction hose that must be coiled or bent to fit within the compartment.

This prior art duct cleaning truck has several disadvantages. First, because the prior art truck has a box-like storage space for storing long lengths of suction hose, a technician must bend or coil the suction hose before placing the suction hose into the storage space in order to fit the suction hose into the storage space. Over time, this may kink the suction hose and obstruct the air flow within the suction hose. Thus, the repeated coiling and bending of the suction hose over time may decrease the efficiency of the suction hose.

A second disadvantage of the prior art duct cleaning truck is that these trucks are only capable of storing 100–150 feet of suction hose. This is because storing the hose in a coiled position is not an efficient storage method. Also, because the coiled suction hose tends to take up a large portion of the storage space in the truck, the truck can not accommodate both 100–150 feet of suction hose and large tools, such as a boroscope or a portable duct cleaner, at the same time.

Another disadvantage of the prior art duct cleaning truck is that these trucks tend to fill with water when they are used in the rain. This is because, when a prior art truck is operated, the hinged top doors of the truck must be open to allow an array of inflatable cloth filters to expand above the truck, as shown in FIG. 7. Because these filters are not waterproof, when a prior art truck is operated in the rain, rainwater tends to seep through the cloth filters and into the truck. Over time, this can cause the interior of the truck to rust.

Another disadvantage of prior art duct cleaning trucks is that they only contain one air hose. Because of this, it is not possible for technicians to use these trucks to simultaneously perform both a forward and a reverse air sweep on a given duct.

SUMMARY OF THE INVENTION

For ease of reference, the duct cleaning apparatus of the present invention is referred to as a "duct cleaning truck." However, it should be understood that the duct cleaning apparatus of the present invention may also comprise a portable duct cleaning apparatus that does not include a truck base, or a stationary duct cleaning apparatus.

The duct cleaning truck of the present invention includes an array of horizontal racks configured to support several substantially straight lengths of suction hose. The present duct cleaning truck also includes an air inlet disposed on a rear portion of the truck, and a plurality of horizontally-disposed dry air filters that are mounted within the interior of a housing disposed on the truck. The duct cleaning truck may also include a plurality of air hoses that may be attached to an air compressor and configured to allow technicians to perform both a forward and a reverse air sweep at the same time. In addition, the duct cleaning truck may be configured to receive a boroscope and a portable air compressor within the housing of the truck.

Therefore, it is an object of present invention to provide an improved duct cleaning apparatus for cleaning the air ducts of houses and other structures.

It is a further object of the present invention to provide an improved duct cleaning apparatus that is configured to maximize space utilization within the apparatus.

It is a further object of the present invention to provide an improved duct cleaning apparatus that allows for the storage of one or more straight lengths of suction hose.

It is a further object of the present invention to provide an improved duct cleaning apparatus that allows suction hose to be stored within the truck without bending the suction hose.

It is a further object of the present invention to provide an improved duct cleaning apparatus that allows for the efficient storage of suction hose.

It is a further object of the present invention to provide an improved duct cleaning apparatus on which the doors of the suction hose storage compartment are on the same side of the truck as the air inlet.

It is a further object of the present invention to provide an improved duct cleaning apparatus that may be used to perform multiple air sweeps at the same time.

It is a further object of the present invention to provide an improved duct cleaning apparatus that may be used to clean ducts more quickly than prior art duct cleaning trucks.

It is a further object of the present invention to provide an improved duct cleaning apparatus with a filtration system that may be operated when the top portion of the truck is substantially closed.

It is a further object of the present invention to provide an improved duct cleaning apparatus that is rust-resistant.

Other objects, features, and advantages of the present invention will become apparent upon reading the following detailed description of the preferred embodiment of the invention, and upon considering this detailed description in conjunction with the appended drawings and claims.

DETAILED DESCRIPTION OF THE PREFERRED EMBODIMENT

Overall Structure

Figure 1:
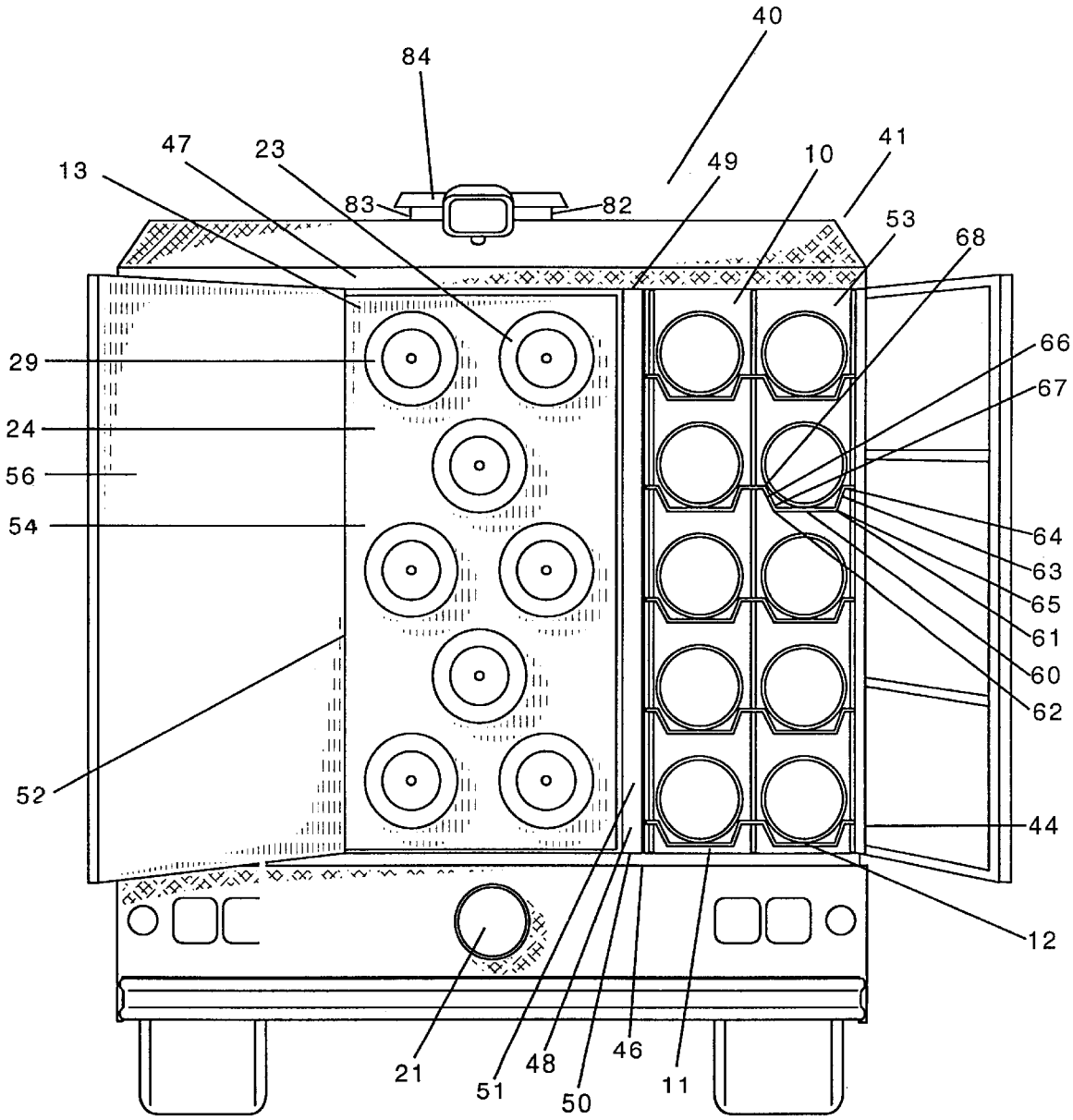
FIG. 1 is a pictorial view of the rear of a duct cleaning truck according to a preferred embodiment of the present invention, in which the rear doors of the truck are shown open.
Figure 2:
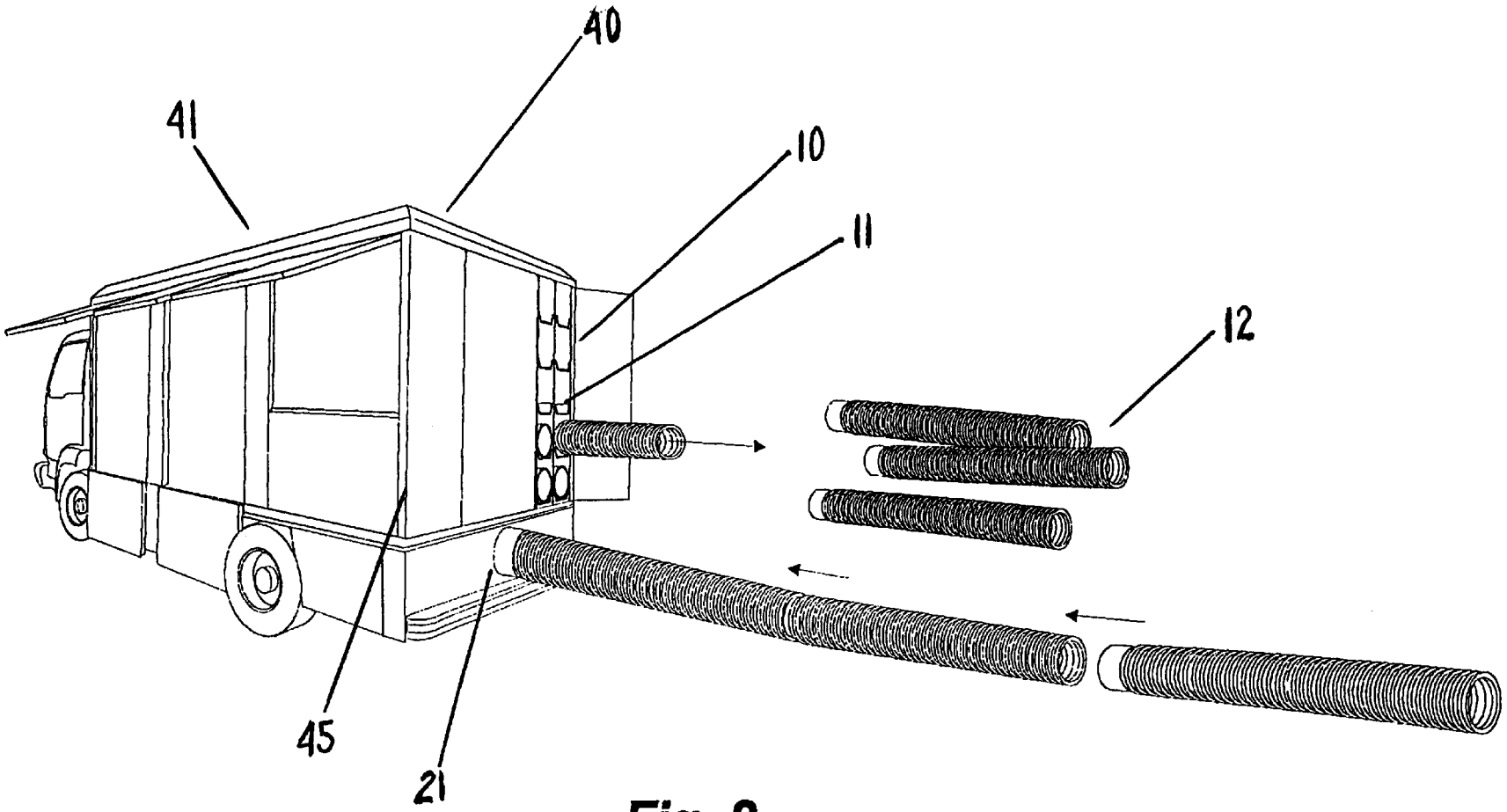
FIG. 2 is a pictorial view of the side and rear portions of the duct cleaning truck shown in FIG. 1. This figure demonstrates the removal of suction hose from the suction hose compartment, and attachment of the hose to an air inlet on the back side of the truck.
Figure 3:
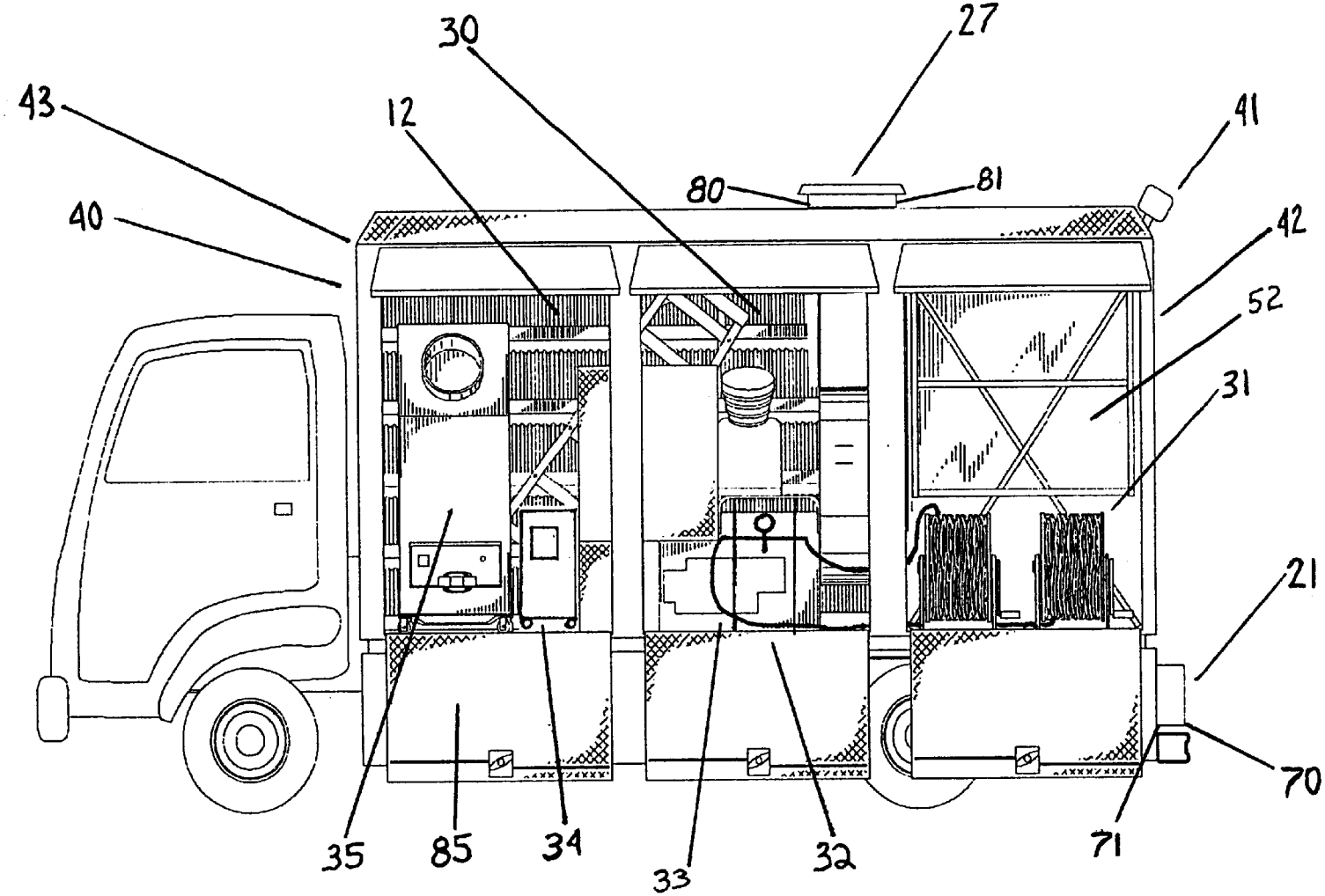
FIG. 3 is a pictorial side view of the truck of FIG. 1 in which the side storage doors of the truck are shown open.
Figure 4:
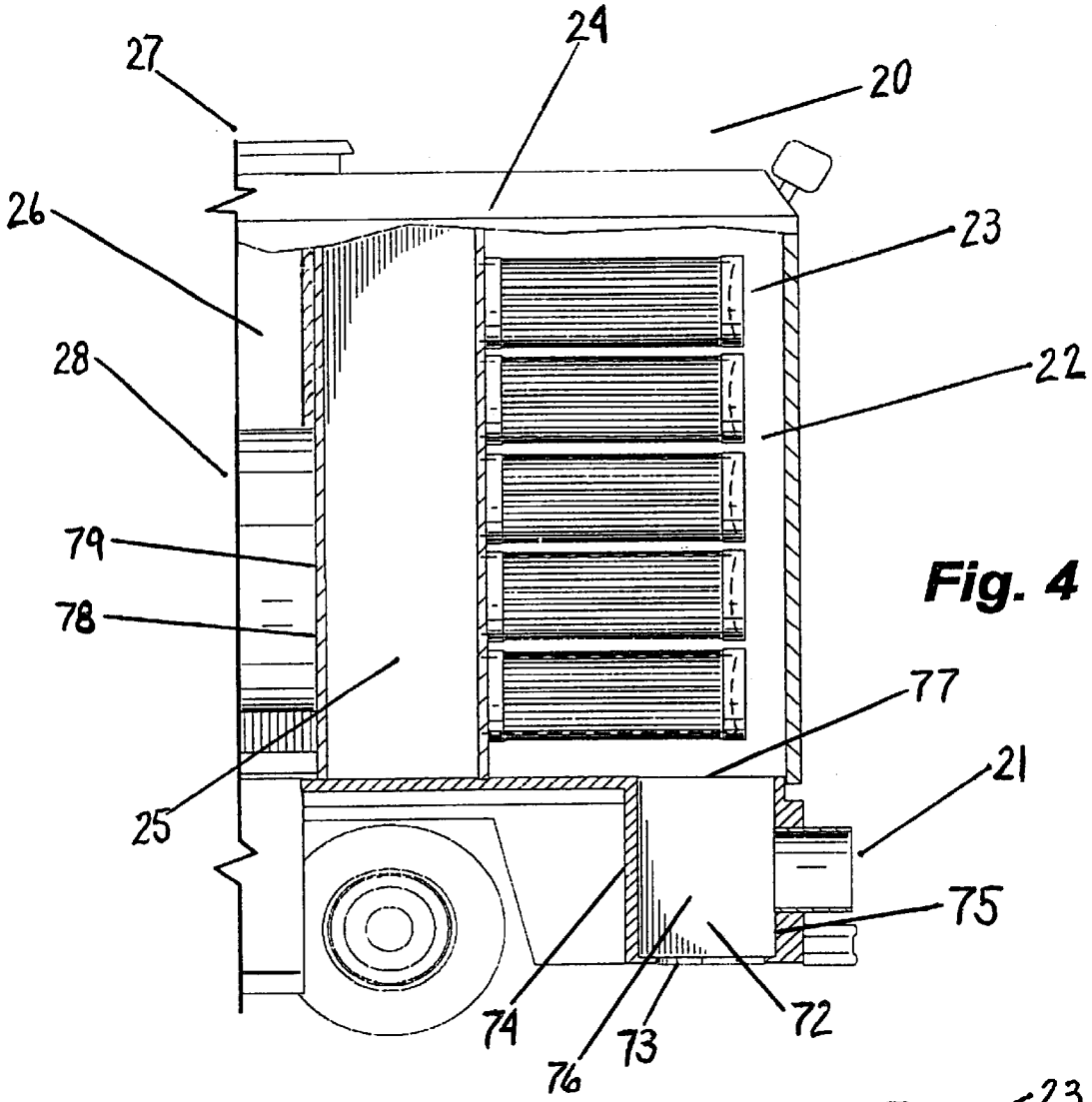
FIG. 4 is a cross-sectional side view of the filtration system in the truck of FIG. 1.
Figure 5:
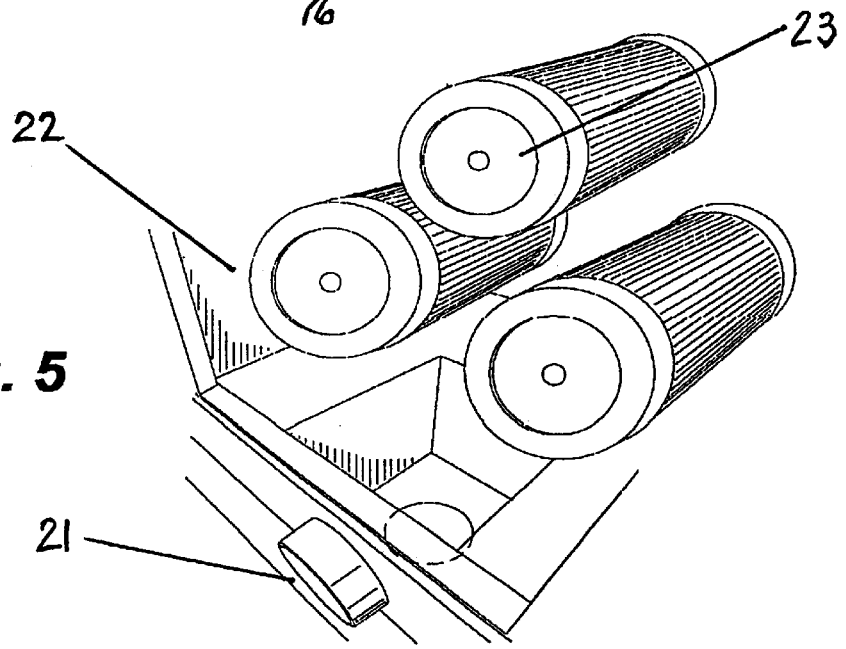
FIG. 5 is an pictorial view of the pre-filter chamber of the truck of FIG. 1.

FIGS. 1–3 show the overall structure of a duct cleaning truck according to a preferred embodiment of the present invention. As shown in FIGS. 1–3, the body 41 of the duct cleaning truck has three compartments: a suction hose compartment 10, a filter compartment 13, and a storage compartment 30. As shown in FIG. 1, the suction hose compartment 10 contains an array of suction hose racks 11 that are configured for storing a plurality of straight lengths of flexible suction hose 12. As shown in FIGS. 1, 4, and 5, the filter compartment 13 also contains an air inlet 21 for receiving dirty air from a house or other structure, and air-filters 23 for filtering airborne particles out of the air. As shown in FIG. 3, the storage compartment 30 contains an air compressor 33, a plurality of air reels 31, a plurality of air hoses 32, and has free space to receive auxiliary equipment such as a boroscope 34 and a portable duct cleaning unit 35. The structure and contents of the duct cleaning truck 40 are discussed in more detail below.

Truck Body

The body 41 of a duct cleaning truck 40 according to a preferred embodiment of the invention includes a substantially planar back wall 42 that is partially defined by a first rear door 55 and a second rear door 56, and a substantially planar front wall 43 parallel to the back wall 42. A substantially planar first side wall 44 and second side wall 45 extend perpendicular to the back wall 42 and the front wall 43, and extend between first and second side edges of the front wall 43 and the back wall 42. A floor 46 extends perpendicular to a bottom edge of the back wall 42, the front wall 43, the first side wall 44, and the second side wall 45, and a substantially planar ceiling 47 parallel to and offset from the floor 46 extends between a top edge of the back wall 42, the front wall 43, the first side wall 44, and the second side wall 45.

The truck body 41 contains a vertical first compartment separator wall 48 that is parallel to, and offset from, the first side wall 44 and the second side wall 45. This first compartment separator wall 48 is substantially planar and extends between the floor 46 and the ceiling 47 of the duct cleaning truck 40. A rear side edge 51 of the first compartment separator wall 48 is adjacent to back wall 42 when the first and second rear doors 55, 56 are closed. The distance between the first compartment separator wall 48 and first side wall 44 is preferably shorter than the distance between the first compartment separator wall 48 and the second side wall 45.

The truck body 41 also contains a vertical second compartment separator wall 52 that is parallel to, and offset from, the first side wall 44 and the second side wall 45. Like the first compartment separator wall 48, this second compartment separator wall 52 is substantially planar and extends between the floor 46 and the ceiling 47 of the duct cleaning truck 40. A rear side edge of the second compartment separator wall 52 is adjacent to the back wall 42 of the duct cleaning truck 40. The distance between the second compartment separator wall 52 and the first side wall 44 is preferably longer than the distance between the second compartment separator wall 52 and the second side wall 45.

Suction Hose Compartment

The truck body 41 contains a suction hose compartment 10 that is defined by the first side wall 44, the first vertical compartment separator wall 48, the floor 46, and the ceiling 47. A technician may access the suction hose compartment 10 through a first rear opening 53 defined by a rear edge of the first side wall 44, a rear edge of the floor 46, a rear edge of the ceiling 47 and a rear edge of the first compartment separator wall 48. The suction hose compartment 10 preferably occupies less than one half of the total volume of the truck body 41.

Filter Compartment

The truck body 41 contains a filter compartment 13 defined by the first compartment separator wall 48, the second compartment separator wall 52, the floor 46, the ceiling 47, and a filter system separator wall 24 that is parallel to and offset from the back wall 42 of the duct truck. The filter system separator wall 24 is perpendicular to, and extends between, the first compartment separator wall 48 and the second compartment separator wall 52. A technician may access the filter compartment 13 through a second rear opening 54 defined by a rear edge of the first compartment separator wall 48, a rear edge of the second compartment separator wall 52, a rear edge of the floor 46, and a rear edge of the ceiling 47. The filter compartment 13 preferably occupies less than one half of the total volume of the truck body 41.

Rear Doors

The truck 40 includes a first rear door 55 that is pivotally connected to the truck body 41 and configured to cover the first rear opening 53 when the first rear door 55 is closed. The truck 40 also includes a second rear door 56 that is pivotally connected to the truck body 41 and configured to cover the second rear opening 54 when the second rear door 56 is closed.

Suction Hose Racks

As shown in FIG. 1, the duct cleaning truck 40 includes a plurality of suction hose racks 11 disposed within the suction hose compartment 10 and dimensioned to receive straight lengths of suction hose 12. These racks 11 are placed along one side of the truck body 41 and preferably extend the entire length between the back wall 42 and the front wall 43 of the truck body 41. The racks are preferably dimensioned to accommodate at least 200 feet of suction hose.

The suction hose racks 11 include a horizontal planar bottom portion 60 having a first side edge 61 and a second side edge 62, a planar first side support portion 63 having a first side edge 64 and a second side edge 65, and a planar second side support portion 66 having a first side edge 67 and a second side edge 68. As shown in FIG. 1, the first side edge 61 of bottom portion 60 engages the second side edge 65 of first side support portion 63 along the length of the first side edge 61 of bottom portion 60. First side support portion 63 extends diagonally up and away from bottom portion 60. As is also shown in FIG. 1, the second side edge 62 of bottom portion 60 engages the first side edge 67 of second side support portion 66 along the length of the second side edge 62 of bottom portion 60. Second side support portion 66 extends diagonally up and away from bottom portion 60.

The suction hose racks 11 are configured so that, when a suction hose 12 is rested on a suction hose rack 11, the bottom portion 60, the first side support portion 63, and the second side support portion 66 engage the suction hose 12. This configuration serves to hold the suction hose 12 in place when the duct truck 40 is in motion. The suction hose racks 11 are also preferably configured so that, when a suction hose 12 is rested on a suction hose rack 11, the bottom portion 60, the first side support portion 63, and the second side support portion 66 are in tangential relation to the suction hose 12. The suction hose racks 11 are preferably configured so that each suction hose rack 11 may only receive a single length of suction hose 12 at a time.

Suction and Filtration System

As may be seen in FIGS. 3, 4, and 5, the suction and filtration system 20 of the duct cleaning truck 40 includes an air inlet 21, disposed on a back end of the truck body 41, that comprises a hollow cylinder that is open at a rear end 70 and a front end 71. As shown in FIG. 1, this air inlet is preferably equidistant between first side wall 44 and second side wall 45. The suction and filtration system 20 also includes a sunken air intake portion 72 that includes a front wall 74, a rear wall 75 offset from and parallel to the front wall 74, a first side wall 76 extending between and perpendicular to a first side edge of the front wall 74 and a first side edge of the rear wall 75, and a second side wall extending between and perpendicular to a second side edge of the front wall 74 and a second side edge of the rear wall 75. The sunken air intake portion 72 further includes a floor portion 73 perpendicular to the front, side, and rear walls of the sunken air intake portion 72 and engaging a bottom edge of the front, side, and rear walls of the sunken air intake portion 72. The top edges of the front wall 74, rear wall 75, first side wall 76, and second side wall of the sunken air intake portion 72 define a top opening 77 in the sunken air intake portion 72. The rear wall 75 defines a hole that is in alignment with air inlet 21 so that air inlet 21 is in gaseous communication with sunken air intake portion 72.

The suction and filtration system 20 also includes a prefilter chamber 22 that is defined by the various interior surfaces of the filter compartment 13. The top opening 77 in the sunken air intake portion 72 is aligned with a hole in a portion of the floor 46 that partially defines the pre-filter chamber so that the sunken air intake portion 72 is in gaseous communication with the pre-filter chamber 22.

As shown in FIG. 4, the front portion of the pre-filter chamber 22 is defined by a filter system separator wall 24.

This filter system separator wall 24 serves to separate the pre-filter chamber 22 from a post filter chamber 25 that is defined by the filter system separator wall 24, the floor 46, the ceiling 47, the first compartment separator wall 48, the second compartment separator wall 52, and a front wall 78 of the post filter chamber 25 that is spaced apart from and parallel to filter system separator wall 24.

As shown in FIG. 1, the filter system separator wall 24 defines an array of air-filter holes 29. Each of these air-filter holes 29 is dimensioned to receive a horizontally disposed air filter 23 as shown in FIG. 4. These air filters 23 are preferably cylindrical pleated cloth air filters. The gap between each air filter 23 and the corresponding air filter hole 29 is sealed with sealing material placed between the air filter 23 and the portion of the filter system separator wall 24 adjacent to the air filter 23. As a result, in order for air to pass from pre-filter chamber 22 to post-filter chamber 25, the air must pass through one or more of the air filters 23.

The front wall 78 of the post-filter chamber 25 defines a blower intake hole 79. This blower intake hole 79 is aligned with the intake of a blower 28 so that air may flow between post-filter chamber 25 and blower 28. The outlet of blower 28 is aligned with a vertical outlet duct 26 that extends between the blower outlet and an air outlet 27. This outlet duct 26 directs air from the outlet of blower 28 out of the duct cleaning truck 40 through air outlet 27.

The air outlet 27 includes a front wall 80, a rear wall 81 offset from and parallel to the front wall 80, a first side wall 82 perpendicular to and extending between a first side edge of front wall 80 and a first side edge of rear wall 81, and a second side wall 83 perpendicular to and extending between a second side edge of front wall 80 and second side edge of rear wall 81. The top edges of the front wall 80, the rear wall 81, and the first and second side walls 82, 83 define a top opening in the air outlet 27. The bottom edges of the front wall 80, the rear wall 81, and the first and second side walls 82, 83 define a bottom opening in the air outlet 27. The air outlet 27 includes a horizontal outlet cap 84 spaced apart from the top opening of the air outlet 27. This outlet cap 84 and the top edges of the front wall 80, the rear wall 81, and the first and second side walls 82, 83 of the air outlet 27 define side outlet openings through which air may flow. The outlet cap 84 prevents moisture from entering the interior of the duct cleaning truck 40.

In a preferred embodiment of the invention, the blower 28 is configured to draw air through the air inlet 21, into the sunken air intake portion 72 and the pre-filter chamber 22, through the air filters 23, and into the post-filter chamber 25. The blower 28 then blows the air from the post filter chamber 25 into the outlet duct 26 and through the side openings in air outlet 27. This process filters the air as the air passes through the air filters 23.

Storage Compartment

The storage compartment 30 of the duct cleaning truck 40 is defined by the front wall 43 of the truck body 41, the back wall 42 of the truck body 41, the second side wall 45 of the truck body 41, the suction hose racks 11, the blower 28, the outlet duct 26, and the second compartment separator wall 52. The storage compartment preferably extends from the front wall 43 to the back wall 42 of the truck body 41 and is accessible through a plurality of side access doors 85. As shown in FIG. 3, the duct cleaning truck 40 preferably includes three upper side access doors that are pivotably attached to the truck body 41 and configured to open up and away from the truck body 41. The duct cleaning truck also preferably includes three lower side access doors that are pivotably attached to the truck body 41 and configured to open down and away from the truck body 41.

The storage compartment 30 is configured to store a standard belt-driven air-compressor 33 between the blower 28 and the front wall 43 of the truck body 41. The storage compartment 30 is also configured to store two air reels 31 and two air hoses 32 between the second side wall 45 and the second separator wall 52. As shown in FIG. 3, a preferred embodiment of the invention is dimensioned to simultaneously accommodate a 10 hp, 34.5 cfm air compressor 33, two air reels 31, two air hoses 32, a boroscope 34, a portable duct cleaning unit 35 and other miscellaneous tools such as ladders, air hose nozzles, and drop cloths.

Use of the Preferred Embodiment

Figure 6:
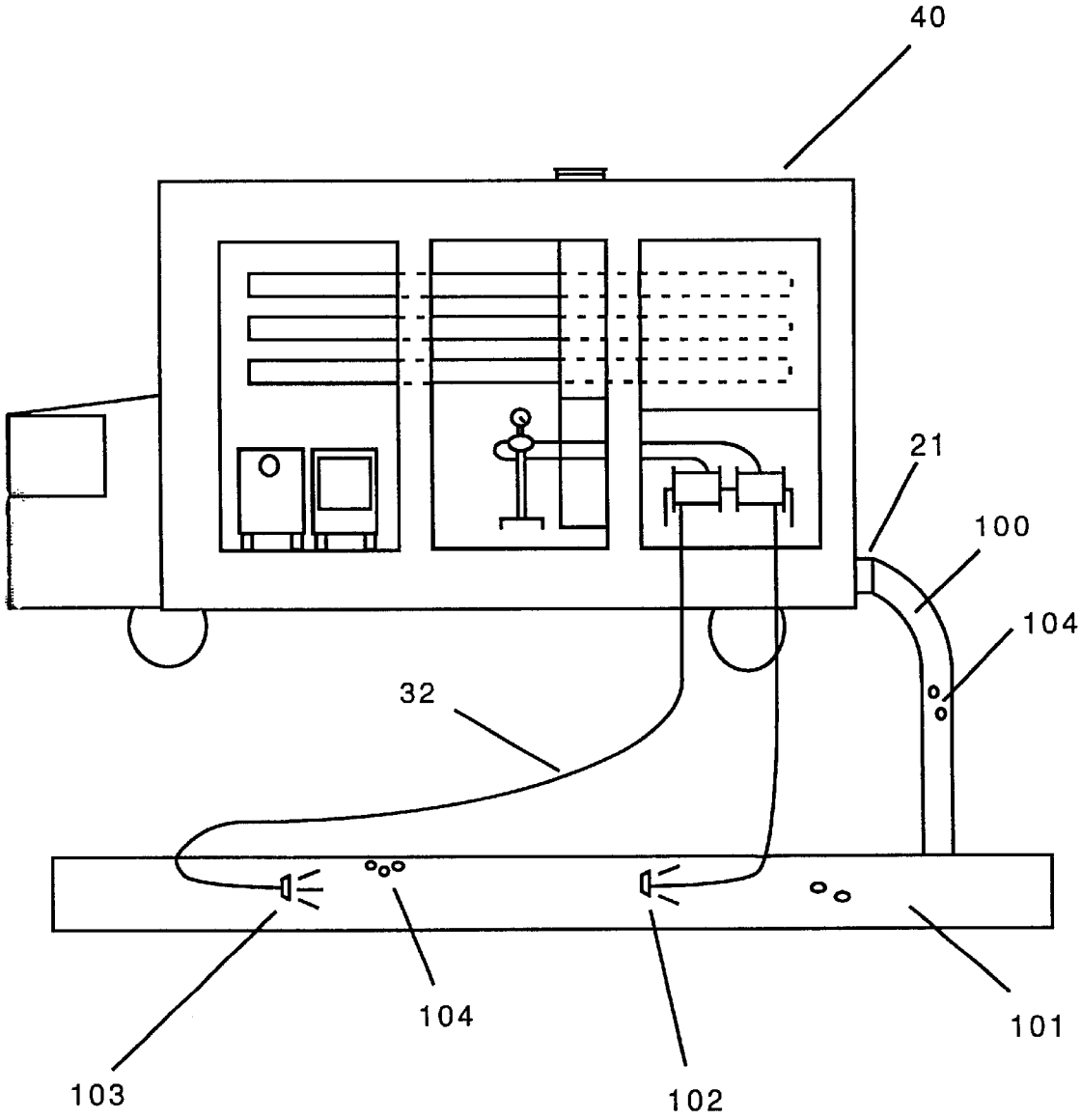
FIG. 6 is a schematic diagram of a duct cleaning truck according to a preferred embodiment of the present invention as the truck is being used to clean a duct by simultaneously performing a forward and a reverse air sweep.
Figure 7:
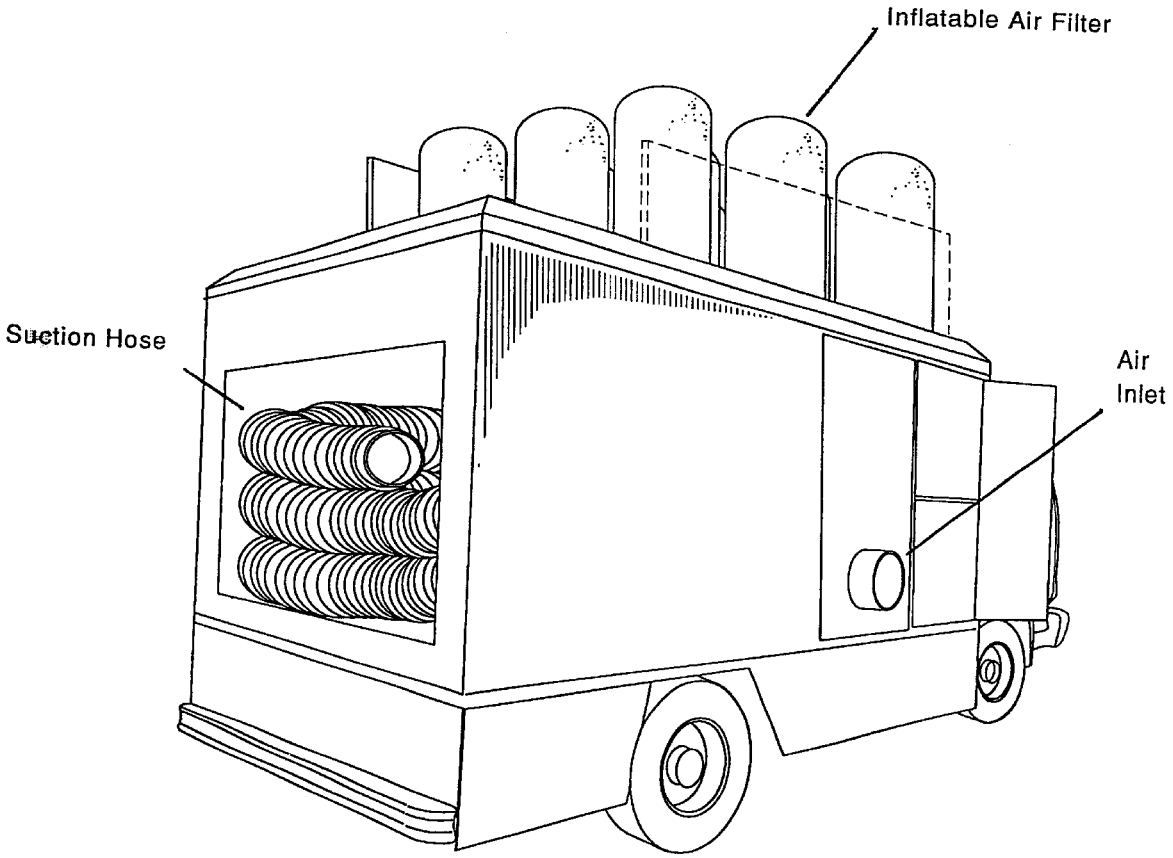
Fig. 7 (PRIOR ART)
FIG. 7 is a pictorial view of a prior art duct cleaning truck having inflatable cloth air filters, a box-style storage space for storing coiled suction hoses, and an air inlet on a side of the truck.

To use the preferred embodiment of the duct cleaning truck of the present invention, a technician first parks the truck near the house or other building to be serviced. The technician then opens one or more rear doors 55 that partially define the suction hose compartment 10 so that the technician has access to the lengths of suction hose 12 stored within the body 41 of the truck. As shown in FIG. 2, the technician then removes a section of suction hose 12 from the duct cleaning truck 40 and connects one end of the section of suction hose 12 to the air inlet 21 disposed at the rear of the duct cleaning truck 40. As shown in FIG. 6, the technician may then remove some or all remaining sections of suction hose 12 and connect the sections of suction hose 12 so that they form a continuous length of suction hose 100 that extends from the air inlet 21 to an air duct near the furnace of the building. The technician then cuts a hole in the air duct near the furnace and connects the free end of the continuous length of suction hose 100 to the hole in the customary manner.

The technician then opens one or more side doors 85 that partially define the storage compartment 30 of the truck 40 so that the technician has access to the air reels 31 and air hoses 32. Technicians may then attach an appropriate nozzle to an end of each air hose 32, activate the blower 28 and the air compressor 33, and then use the two air hoses 32 to simultaneously perform two air sweeps within the ducts using the techniques described above. For example, as shown in FIG. 6, if the technicians desire to clean a straight 20-foot section of duct that is positioned so that the technicians can not access the section in order to cut a 1-inch hole in the middle of the section, the technicians may cut a 1-inch hole at the upstream end of the 20-foot section of duct and a 1-inch hole at the downstream end of the 20-foot section of duct. The user may then clear debris 104 from the interior of the 20-foot section of duct by simultaneously performing a reverse air sweep through the downstream 1-inch hole and a forward air sweep through the upstream 1-inch hole as shown in FIG. 6. In other situations, the two air hoses 32 may also be used to simultaneously perform two reverse air sweeps, or two forward air sweeps. The advantage of performing a plurality of air sweeps simultaneously is that it reduces the time needed to clean a given length of air duct.

As mentioned above, when the air sweeps are performed, debris 104 is dislodged form the interior surfaces of the ducts so that the debris 104 becomes airborne. Once airborne, the debris 104 is sucked through the duct and into the continuous length of suction hose 100 as shown in FIG. 6. As may be understood from FIG. 4, the debris 104 is then sucked through air inlet 21, through sunken air intake portion 72 and pre-filter chamber 22, and into the array of air filters 23 where the debris 104 is filtered from the air. The blower 28 then blows the filtered air through outlet duct 26 and out air outlet 27. The debris 104 may later be removed from the air filters 23 by washing the air filters with water.

If desired, the technicians may remove a portable duct cleaning unit 35 from the duct cleaning truck 40 and use the portable duct cleaning unit 35 to clean portions of the duct that are difficult to reach with the truck-mounted duct cleaning apparatus. In addition, after cleaning the ducts, the technicians may remove a portable boroscope 34 from the truck and use the boroscope 34 to probe the interior of the ducts to verify that all debris has been removed from the interior surfaces of the ducts.

CONCLUSION

While this invention has been described in specific detail with reference to the disclosed embodiments, it will be understood that many variations and modifications may be made within the spirit and scope of the invention as described in the appended claims.

What is claimed:

1. Duct cleaning apparatus comprising:

a housing configured to mount on a vehicle and having plural compartments;

a blower mounted in the housing and operative to produce suction at an air inlet at one end of the housing and deliver air to an air outlet;

a plurality of racks within a compartment of the housing and configured to receive substantially straight lengths of suction hose having predetermined length and diameter;

the racks being substantially aligned with an access opening at the one end of the housing, so as to permit removing the hoses from the rack through the access opening in proximity for coupling the hoses to the air inlet at the one end; and air filter means contained within the housing and operative to remove particulate matter from the air exiting the air outlet of the blower, the air filter means being located adjacent the one end of the housing and at one side of the rack so as to optimize space utilization within the housing.

2. Apparatus as in claim 1, wherein:

the housing has first and second longitudinal sides;

the rack is located at one side of the housing and supports the suction hose substantially parallel to the one side; and the air filter means is located adjacent the one end of the housing at the side of the rack spaced apart from the one side of the housing.

3. Apparatus as in claim 2, wherein:

the blower is located substantially in front of and adjacent to the air filter means, with the air outlet connected to admit air to an inlet of the air filter means; and the blower and air filter means are spaced apart from the other side of the housing so as to provide a useful region therebetween.

4. Apparatus as in claim 1, further including a removable portable air compressor disposed within the housing.

5. Apparatus as in claim 1, wherein a top portion of the housing is configured to be substantially closed during operation of the apparatus.

6. Apparatus as in claim 1, further including a door partially defining the compartment within which the plurality of racks is disposed, the door being disposed on the same surface of the housing as the air inlet.

7. Apparatus as in claim 6, wherein the surface is a back end of the truck.

8. Apparatus as in claim 1, further including a plurality of air reels for supporting at least a first and a second air hose, the first air hose removably engaging a compressor at a first end of the first air hose, and the second air hose removably engaging the compressor at a first end of the second air hose.

9. Apparatus as in claim 8, wherein the first air hose is configured for detachable engagement with a forward air sweep nozzle, the second air hose is configured for detachable engagement with a reverse air sweep nozzle, and the duct cleaning apparatus is configured to provide a positive air pressure in the first and second air hoses while simultaneously producing suction at the air inlet.

10. Apparatus as in claim 9, wherein the first air hose and the second air hose are configured so that the first air hose may be used to perform a forward air sweep of a duct while the second air hose is simultaneously being used to perform a reverse air sweep of a duct.

* * * * *